US007244146B2

(12) United States Patent
Gherardini

(10) Patent No.: US 7,244,146 B2
(45) Date of Patent: Jul. 17, 2007

(54) HIGH DENSITY RF CONNECTOR SYSTEM

(75) Inventor: Stephen Daniel Gherardini, Harrisburg, PA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/481,637

(22) Filed: Jul. 6, 2006

(65) Prior Publication Data

US 2007/0026731 A1 Feb. 1, 2007

Related U.S. Application Data

(60) Provisional application No. 60/702,390, filed on Jul. 26, 2005.

(51) Int. Cl.
*H01R 33/945* (2006.01)

(52) U.S. Cl. ..... 439/585

(58) Field of Classification Search ..... 439/585
See application file for complete search history.

(56) References Cited

U.S. PATENT DOCUMENTS 4,008,941 A 2/1977 Smith
4,449,779 A 5/1984 Hampshire
4,548,453 A 10/1985 Mummey et al.
4,666,232 A 5/1987 Shyu
4,861,271 A 8/1989 Bogar et al.
4,927,385 A 5/1990 Cheng
4,975,066 A 12/1990 Sucheski et al.
4,990,104 A * 2/1991 Schieferly ..... 439/578
4,990,105 A * 2/1991 Karlovich ..... 439/578
5,123,864 A * 6/1992 Karlovich ..... 439/585
5,147,221 A 9/1992 Cull et al.
5,931,698 A * 8/1999 Kodama ..... 439/578
6,210,223 B1 * 4/2001 Aoyama et al. ..... 439/585
6,443,740 B1 9/2002 Evans
6,482,033 B2 * 11/2002 Togashi et al. ..... 439/578
7,074,057 B2 * 7/2006 Chiran et al. ..... 439/92

* cited by examiner

*Primary Examiner*—Briggitte R. Hammond
(74) *Attorney, Agent, or Firm*—Peter Van Winkle

(57) ABSTRACT

A coaxial connector has inner and outer contacts (34, 36) connected to inner and outer conductors (20, 22) of a coaxial cable (14), in a contact arrangement of small diameter (A), so each coax contact arrangements can carry high frequency signals. The outer contact has a rear portion (70) lying within the cable outer conductor (22) and locked in place by a crimp sleeve (72), and the outer contact has a front portion (74) that projects forward of a housing front face (80) and that has laterally opposite sides (82, 84) that are exposed to be contacted. The housing has a forward projection (102) with projection portions (104, 106) that lie on longitudinally (M) opposite sides of the outer contact front portion and that have projection front ends that merge and support the center contact (34) at a location forward of the outer conductor.

10 Claims, 4 Drawing Sheets

F
L
R
40
34
42
108
102
100
96
94
99
32
74
36
44
80
124
72
70
30
90
92
12
10
22
20
24
26
14
B
A
1A
1A
40
108
126
128
82
84
116
30
22F
114
115
75

20
24
72
22
36, 70

HIGH DENSITY RF CONNECTOR SYSTEM

CROSS-REFERENCE

Applicant claims priority from U.S. Provisional patent application Ser. No. 60/702,390 filed Jul. 26, 2005.

BACKGROUND OF THE INVENTION

There is a need for a coaxial, or coax connector with multiple contact pairs for connecting to multiple coax cables. Each contact pair includes inner and outer contacts that connect, respectively, to the inner and outer conductors of a coax cable. Front ends of the contacts must be able to connect to mating contacts of a mating connector device, such as a connector device that lies on a circuit board. Each pair of contacts should be of small diameter so it can carry high frequency signals. Also, on most circuit boards there is limited space so the contacts and mating contacts must be closely spaced. A coax connector with contact pairs of simple and compact construction and mounting, would be of value.

SUMMARY OF THE INVENTION

In accordance with one embodiment of the invention, a combination of a coax cable with inner and outer coax conductors and a coax contact pair comprising inner and outer contacts, is provided that enables the cable conductors to be easily terminated to the contacts, and with the combination having a small outside diameter that is only moderately greater than that of the coax cable alone. The insulative connector housing has a front face, and the outer contact has a front portion lying forward of the housing front face and having laterally opposite sides that are exposed, to be contacted. The housing has a forward projection that projects forward of said housing front face, that lies on longitudinally opposite sides of the outer contact front portion, and that has a front end that supports the inner contact.

The outer contact is connected to the cable outer conductor, by the cable outer conductor being crimped to a rear portion of the outer contact rear portion. The outer contact front portion has exposed surfaces. The cable insulator and cable inner conductor extend though the outer conductor, and the cable inner conductor extends forward of the cable insulator. The inner contact has a hole that receives the front end of the cable inner conductor.

The novel features of the invention are set forth with particularity in the appended claims. The invention will be best understood from the following description when read in conjunction with the accompanying drawings.

DETAILED DESCRIPTION OF THE INVENTION

Figure 1:
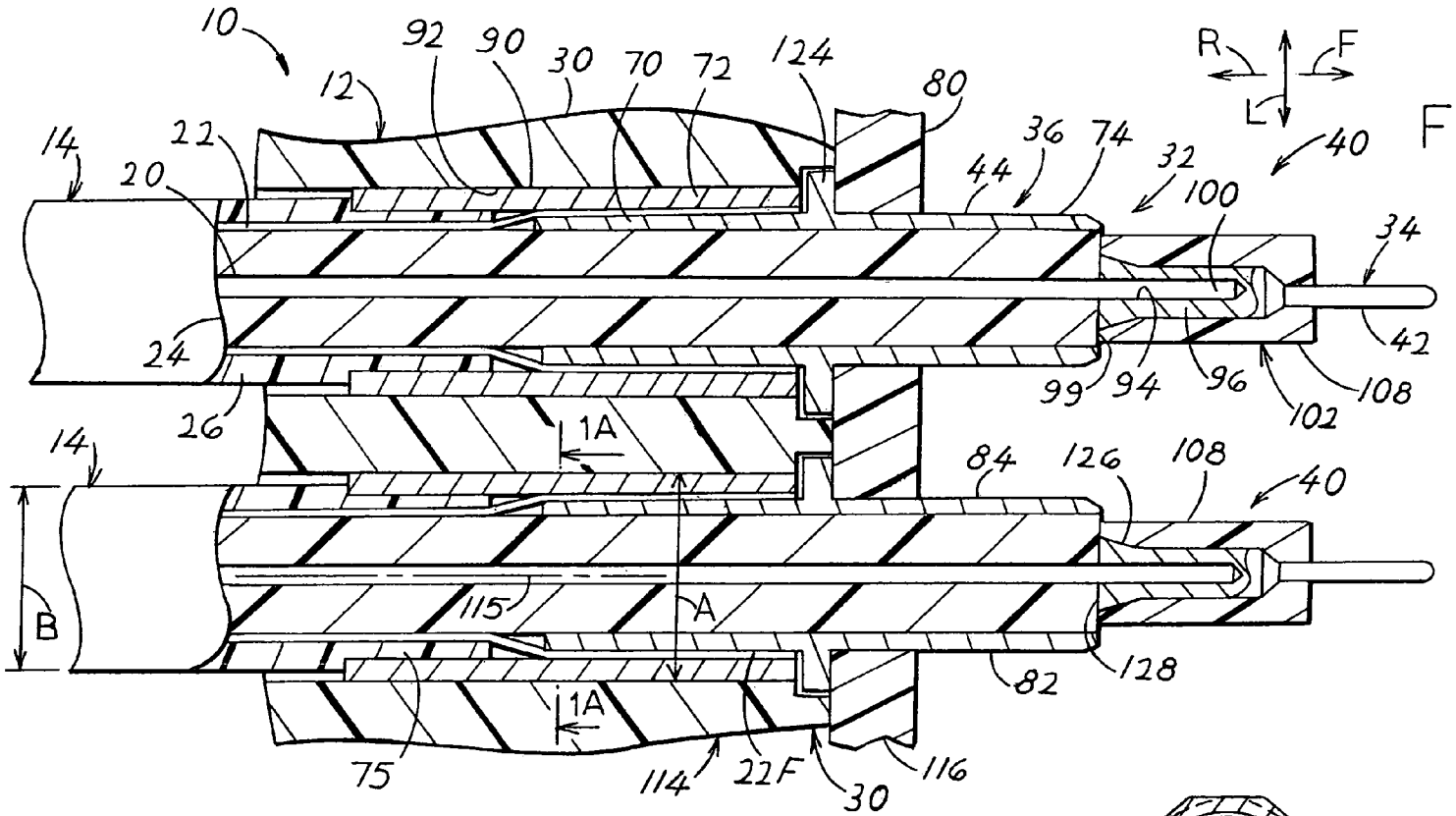
FIG. 1 is a partial sectional view of a connector of the present invention.
Figure 1A:
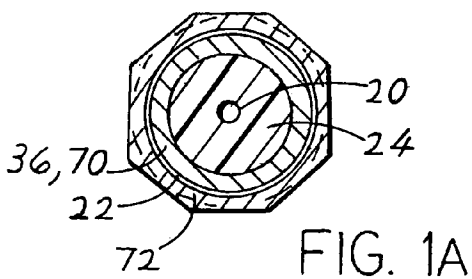
FIG. 1A is a sectional view taken on line 1A-1A of FIG. 1.

FIG. 1 illustrates a connector arrangement 10 which includes a coax connector 12 and a plurality of coax cables 14. Each coax cable includes inner and outer cable conductors 20, 22 and an insulator 24 lying between them. A jacket 26 lies around the outer cable conductor. The coax connector includes a housing 30 of dielectric, or insulative material, and a plurality of coax contact pairs 32 each lying in a housing passage 92 in the housing. Each coax contact pair includes an inner contact 34 that is connected to the inner cable conductor 20 and an outer contact 36 that is connected to the outer cable conductor 22. Each coax cable 14 and a coax contact pair 32 forms a combination 40.

Figure 2:
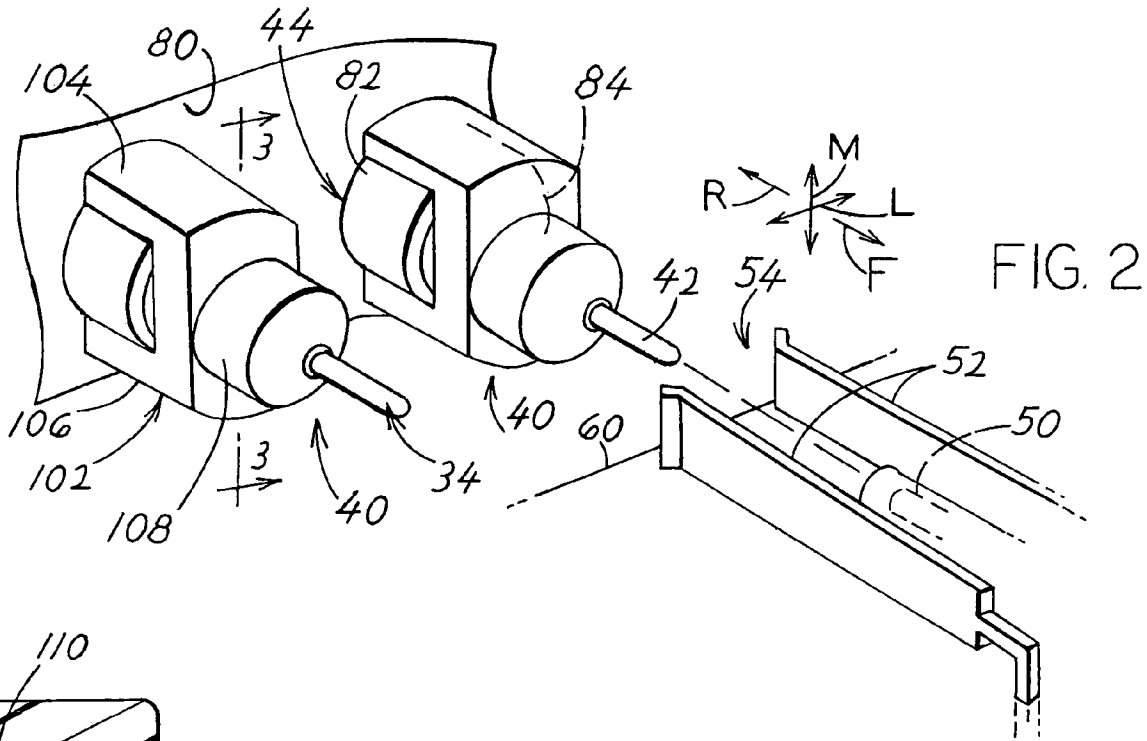
FIG. 2 is an exploded partial isometric view of the connector of FIG. 1, and showing a portion of a mating connector device that can mate with the connector of FIG. 1.
Figure 3:
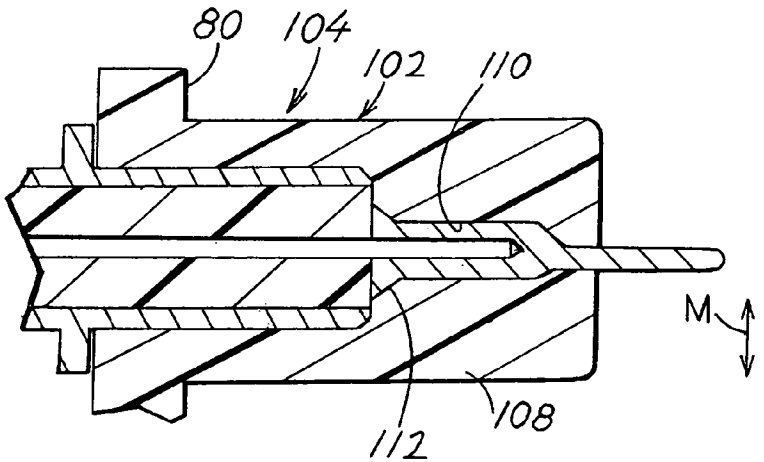
FIG. 3 is a partial sectional view taken on line 3-3 of FIG. 2.

As shown in FIG. 2, the inner and outer contacts have mating front portions, or ends 42,44 that lie at the front of the connector and that are designed to engage, or mate, with inner and outer contact elements 50, 52 of a mating connector device 54. The outer contacts of the connector and connector device should mate before the inner contacts mate, and the inner contact element front portion at 50 is set forward F to assure this. The contacts 34, 36 of the contact pair 32 should be closely spaced to carry high frequency signals (e.g. 3 GHz) through the connector. Also, the connector device 54 is shown mounted on a circuit board 60 that has a limited amount of space , so it is desirable that each combination 40 of a coax cable and coax contact pair have a small diameter to allow close spacing of the combinations.

The outer cable conductor 22, shown in FIG. 1 is usually in the form of a braiding that can be readily expanded. To connect the outer contact 36 to the outer cable conductor 22, applicant expands the outer cable conductor and then rearwardly R inserts a rear portion 70 of the outer contact 36 into a front end 22F of the braiding. Applicant also places a crimp sleeve 72 around the braiding and around a front portion 75 of the cable jacket. When the crimp sleeve 72 is crimped, as to the octagonal shape illustrated, the braiding of the outer cable conductor is locked to both the crimp sleeve and to the rear portion 70 of the outer contact, and the cable jacket is held to the crimp sleeve.

The outer contact front portion 44 shown in FIG. 2 projects forward of the front face 80 of the housing 30. The outer contact has exposed locations 82, 84 at laterally L opposite sides of its front portion. The exposed locations 82, 84 can be easily engaged by the resilient blades 52 that are part of the outer contact element of the mating connector device 54.

Figure 4:
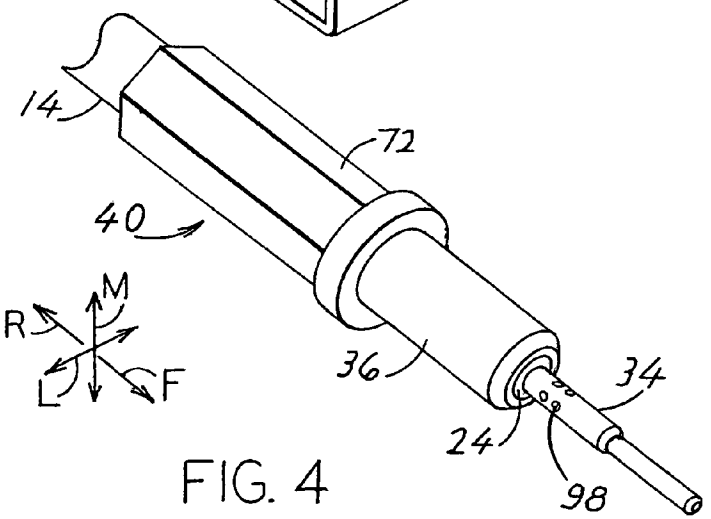
FIG. 4 is a front isometric view of one of the connector and cable combination of FIG. 1.

The position of the outer contact 36 (FIG. 1) on the connector housing is held against rattling by the crimp sleeve 72 lying closely in the housing passage 92. In this case such holding of the crimp sleeve to the housing is achieved by a close fit between each crimp sleeve and the walls 90 of a corresponding one of many passages 92 in the connector housing. The crimp sleeve was originally in a cylindrical shape, but is crimped into an octagon shape as shown in FIG. 4.

The inner contact 34 (FIG. 1) is connected to the cable inner conductor 20 by forming the inner contact with a hole 94 in its rear end 96 that receives the front end 100 of the cable inner conductor. The hole 94 has 360° continuous walls (i.e. no slots in the walls), so the hole can be simply drilled. The connection can be made by crimping the inner contact rear part around the cable inner conductor as at locations 98 (FIG. 4), by soldering, or in other known ways. The inner contact 34 extends forward of the cable insulator front end 99. The position of the cable inner conductor is stabilized to some extent by the fact that it lies in the cable insulator 24 that lies within the front portion 44 of the rigid outer contact. However, there is a high possibility that the inner cable conductor will bend and therefore allow the inner contact 34 to tilt considerably, if the inner contact is not closely supported.

Applicant supports the inner contact 34 by forming the insulative housing with a forward housing projection 102 that projects forward of the front face 80 of the housing. The projection has projection parts 104, 106 that lie on longitudinally M opposite sides (which are vertical opposite sides in the drawings) of the outer contact 36, but the projection does not cover the laterally L opposite sides 82, 84 (which are horizontally spaced in the drawings) of the outer contact. The directions L and M are perpendicular to each other and to an axis 115 of each passage which extends in forward and rearward directions F, R. The projection parts 104, 106 merge into a holder 108 at the front of the projection and the holder forms a guide passage 110 that closely surrounds a rear portion 112 of the inner contact.

Figure 5:
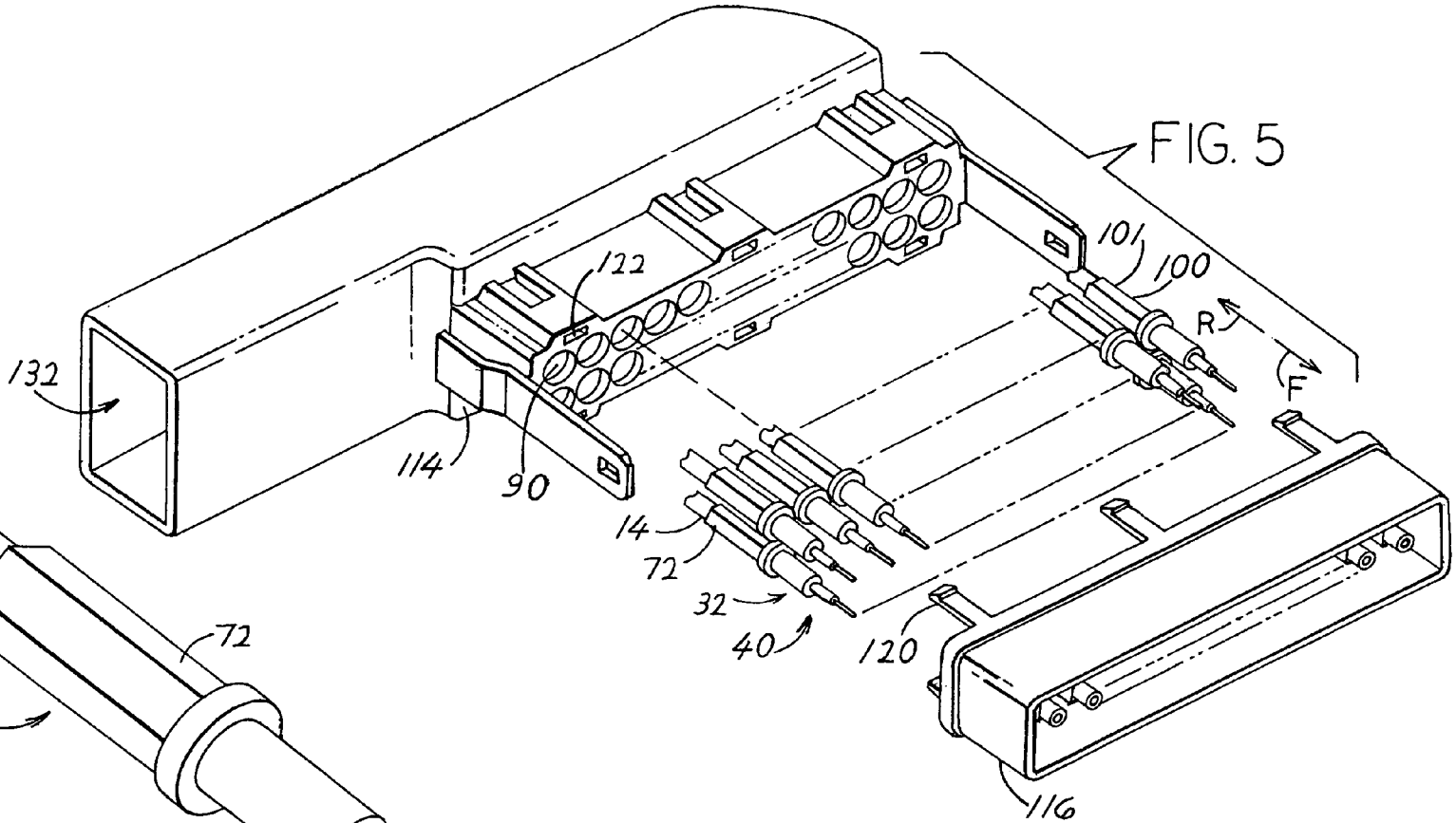
FIG. 5 is a front exploded isometric view of the connector of FIG. 1, with only portions of the cables shown.

The connector shown in FIG. 5 has twenty-four cables 14 and corresponding pairs of contacts, arranged in two rows. Each combination 40 of a cable 14 and coax contact pair 32 is assembled outside the connector housing. The cables are moved rearwardly through housing passages 90 in an insulative plastic rear housing part 114, until the deformed crimp sleeves 72 slide rearwardly into a close fit into the passages. Then an insulative front housing part 116 is moved rearwardly R into position, and hooks 120 at the rear ends of arms of the front housing part slide into holes 122 in the rear housing part and snap behind shoulders. As shown in FIG. 1, each outer contact has a flange 124 that abuts a rear face of the housing front part 116 to help position the outer contact. The inner contact has a chamfered rear part 126 and has a rear surface 128 that form shoulders to prevent it from moving rearward and/or forward relative to the holder 108 of the housing projection, although applicant finds that this generally is not necessary.

Figure 6:
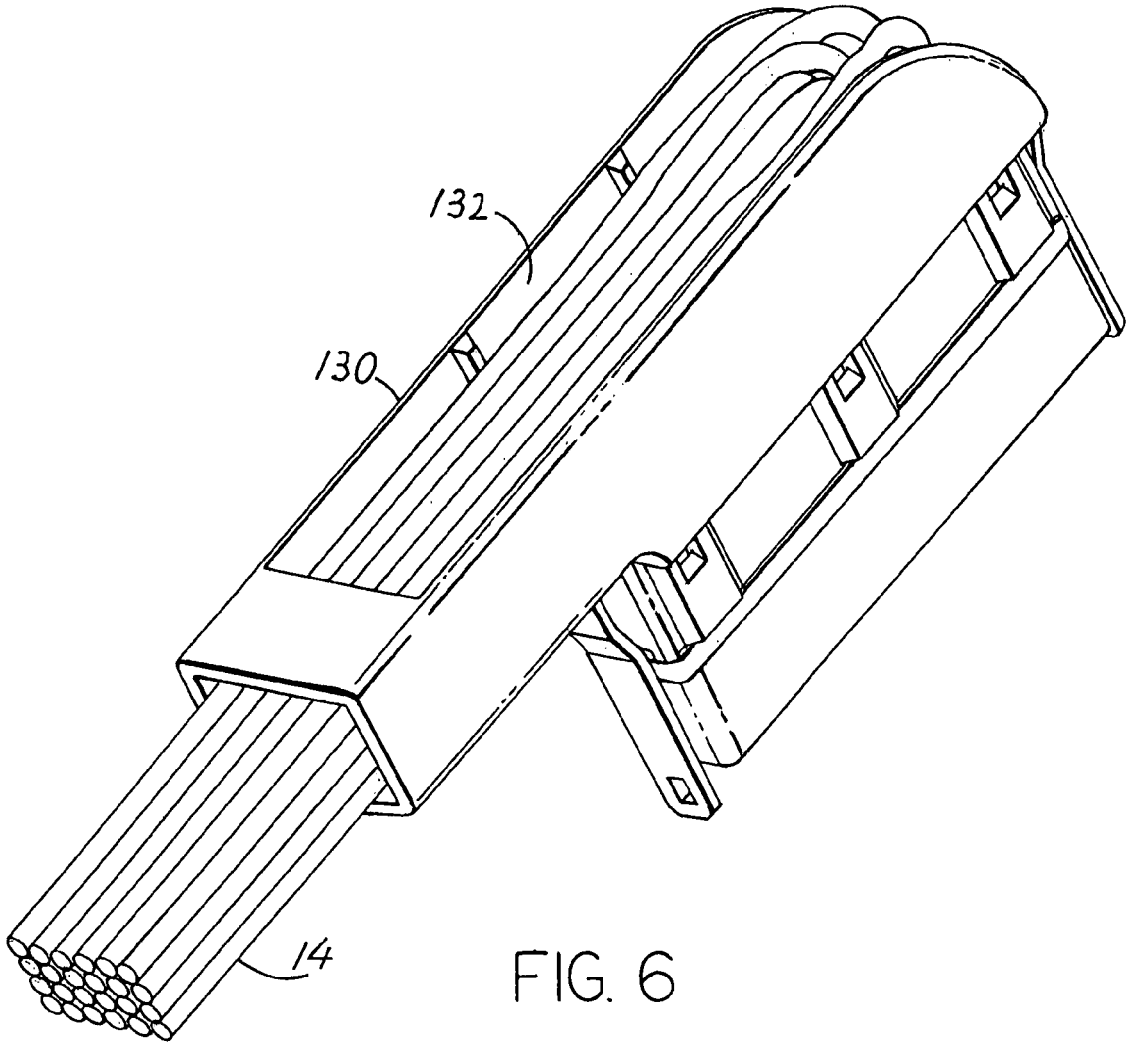
FIG. 6 is a rear isometric view of the connector of FIG. 1.

It can be seen from FIG. 1 that the largest diameter A of the combination, which occurs at the outside of the crimp sleeve 72 is less than 125% and actually less than 115% of the diameter B of the cable at its jacket. This allows close spacing of the combinations, and therefore the packing of many contact pairs and many combinations in a connector of given size. From FIG. 6 it can be seen that the rear of the connector has an open rear end 130 that allows the cables to be easily threaded through the passages and then bent and laid in a channel 132.

Thus, the invention provides a coax connector and a combination of a coax cable and pair of coax contacts that lie in a housing, wherein the combination is constructed so it occupies a minimum diameter and has a minimum number of parts. The outer contact has a front portion that projects forward of a housing front face and has laterally opposite sides that are exposed. The housing has a forward projection that includes parts that lie on longitudinally opposite sides of the outer contact and that merge at their front ends to form a holder. The holder holds the inner contact by closely surrounding it, to minimize its tilt. The outer contact has a rear portion that is crimped to the cable outer conductor by a crimp sleeve that is fixed in position in the housing.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. The combination of a coaxial connector and a coaxial cable, wherein the coaxial cable has inner and outer cable conductors and an insulator between them and the coaxial connector has an insulative housing with a housing front face and has inner and outer contacts that are connected to said cable conductors, wherein:

said outer contact has a front portion lying forward of said housing front face with at least one side of said outer contact being exposed and said inner contact projects further forward than said outer contact, said housing has at least one forwardly-projecting housing insulative projection (102) that projects forwardly from said housing front wall and that lies beside the front portion of the outer contact but not on said exposed side of said outer contact, and said housing has an insulative holder (108) that projects forward from a front end of said projection and that supports a portion of said inner contact that extends forward of said outer contact.

2. The combination of a coaxial connector and a coaxial cable wherein the cable has inner and outer cable conductors and a cable insulator between them, the connector having a housing and having a contact pair comprising inner and outer contacts with front mating ends, said inner and outer contacts connected to said inner and outer cable conductors, wherein:

said outer contact is rigid and said outer cable conductor lies around a rear portion of said outer contact, and including a crimp sleeve that is crimped around said outer cable conductor and said rear portion of said outer contact to mechanically and electrically connect said outer cable conductor to said outer contact, said outer contact having an exposed front end and said cable insulator extends within said outer contact to said outer contact front end;

said inner cable conductor has a front end extending forward of a front end of said cable insulator, said connector inner contact having a rear end connected to said inner cable conductor front end.

3. The combination described in claim 2 wherein:

said connector inner contact has a hole in its rear end that receives a front end of said inner cable conductor.

4. The combination described in claim 2 wherein:

said housing includes a housing rear part that forms passages, with said crimp sleeve lying closely in one of said passages, and said housing has a housing front part that forms a hole that closely receives said outer contact and that forms a forward extension with a front end that closely surrounds said inner contact, said forward extension leaving open spaces on laterally opposite sides of said outer contact front end.

5. The combination described in claim 2 wherein said coaxial cable is one of a plurality of coaxial cables and said contact pair is one of a plurality of contact pairs, and including a plurality of mating connector devices, wherein:

said outer contact front ends have laterally opposite sides that are exposed;

said mating connector devices each includes inner and outer contact devices, each outer contact device comprising a pair of beams with a rear end separated by less than the separation of said outer contact side surfaces to engage said sides of said outer contact front end, and each inner contact device lies forward of the beam rear ends.

6. The combination described in claim 2 wherein:

said housing includes a housing front part that closely surrounds said outer contact at a location forward of said crimp sleeve, and a housing rear part with a passage that lies in an interference fit with said crimp sleeve.

7. The combination described in claim 6 wherein:

said housing front part extends beside longitudinally opposite second sides of said outer contact while leaving laterally opposite sides of said outer contact exposed.

8. The combination of a coaxial connector and a coaxial cable, wherein the coaxial cable has inner and outer cable conductors and an insulator between them and the coaxial connector has an insulative housing with a housing front wall and has inner and outer contacts that are connected to said cable conductors, wherein:

said outer contact has a front portion lying forward of said housing front wall with at least one side of said outer contact being exposed, and said housing has at least one forwardly-projecting housing projection that projects forwardly from said housing front wall and that lies beside the front portion of the outer contact but not on said exposed side of said outer contact, said housing projection having a front end that supports said inner contact;

said outer contact is in the form of a rigid tube with rearward and forward portions; and including a crimp sleeve, said outer cable conductor having a front end lying around said outer contact rear portion, and said crimp sleeve being crimped around said outer cable conductor front end.

9. The combination of a coaxial connector and a coaxial cable, wherein the coaxial cable has inner and outer cable conductors and an insulator between them and the coaxial connector has an insulative housing with a housing front wall and has inner and outer contacts that are connected to said cable conductors, wherein:

said outer contact has a front portion lying forward of said housing front wall with at least one side of said outer contact being exposed, and said housing has at least one forwardly-projecting housing projection that projects forwardly from said housing front wall and that lies beside the front portion of the outer contact but not on said exposed side of said outer contact, said housing projection having a front end that supports said inner contact;

said outer contact front portion has laterally opposite sides that are both exposed, and said housing projection has projection portions lying on longitudinally opposite sides of said outer contact, said projection portions having front ends that merge.

10. The combination of a coaxial connector and a coaxial cable, wherein the coaxial cable has inner and outer cable conductors and an insulator between them and the coaxial connector has an insulative housing with a housing front wall and has inner and outer contacts that are connected to said cable conductors, wherein:

said outer contact has a front portion lying forward of said housing front wall with at least one side of said outer contact being exposed, and said housing has at least one forwardly-projecting housing projection that projects forwardly from said housing front wall and that lies beside the front portion of the outer contact but not on said exposed side of said outer contact, said housing projection having a front end that supports said inner contact;

said connector inner contact has a rear end with a hole that receives a front end of said cable center conductor.

* * * * *